US010953288B2

(12) United States Patent
Watanabe

(10) Patent No.: US 10,953,288 B2
(45) **Date of Patent: *Mar. 23, 2021**

(54) MULTI-PIECE SOLID GOLF BALL

(71) Applicant: Bridgestone Sports Co., Ltd., Tokyo (JP)

(72) Inventor: Hideo Watanabe, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/843,393

(22) Filed: Apr. 8, 2020

(65) Prior Publication Data

US 2020/0353317 A1 Nov. 12, 2020

(30) Foreign Application Priority Data

May 9, 2019 (JP) ..... JP2019-088999

(51) Int. Cl.
*A63B 37/06* (2006.01)
*A63B 37/00* (2006.01)

(52) U.S. Cl.
CPC ..... *A63B 37/0092* (2013.01); *A63B 37/0031* (2013.01); *A63B 37/0075* (2013.01); *A63B 37/0087* (2013.01)

(58) Field of Classification Search
CPC ..... A63B 37/0092; A63B 37/0062; A63B 37/0063
USPC ..... 473/376
See application file for complete search history.

(56) References Cited

U.S. PATENT DOCUMENTS

2011/0028245 A1* 2/2011 Nakagawa ..... A63B 37/0007 473/383
2011/0224024 A1* 9/2011 Tutmark ..... A63B 37/0022 473/378
2012/0157233 A1* 6/2012 Watanabe ..... A63B 37/0031 473/373
2013/0217516 A1* 8/2013 Komatsu ..... A63B 37/0003 473/374
2014/0194221 A1 7/2014 Watanabe et al.
2015/0258388 A1 9/2015 Watanabe et al.
(Continued)

FOREIGN PATENT DOCUMENTS

JP 2001-017569 A 1/2001
JP 2001-017570 A 1/2001
(Continued)

*Primary Examiner* — Raeann Gorden
(74) *Attorney, Agent, or Firm* — Sughrue Mion, PLLC

(57) ABSTRACT

In a multi-piece solid golf ball having a core, an envelope layer, an intermediate layer and a cover, the envelope layer is formed into two layers—an inner envelope layer and an outer envelope layer. The inner envelope layer-encased sphere, outer envelope layer-encased sphere, intermediate layer-encased sphere and ball have respective surface hardnesses that satisfy a specific relationship. The inner envelope layer or outer envelope layer is formed primarily of one or more thermoplastic elastomer selected from the group consisting of polyester elastomers, polyamide elastomers, polyurethane elastomers, olefin elastomers and styrene elastomers. This ball has an excellent flight when struck by golfers whose head speeds are not that fast and has a good, soft feel at impact, thus making it highly suitable for amateur golfers.

7 Claims, 2 Drawing Sheets

(56) References Cited

U.S. PATENT DOCUMENTS

| | | | |
|---|---|---|---|
| 2016/0008667 | A1 | 1/2016 | Watanabe et al. |
| 2016/0279484 | A1 | 9/2016 | Watanabe et al. |
| 2018/0256944 | A1 | 9/2018 | Watanabe |

FOREIGN PATENT DOCUMENTS

| | | | |
|---|---|---|---|
| JP | 2014-132955 | A | 7/2014 |
| JP | 2015-173860 | A | 10/2015 |
| JP | 2016-016117 | A | 2/2016 |
| JP | 2016-179052 | A | 10/2016 |
| JP | 2018-148990 | A | 9/2018 |

* cited by examiner

MULTI-PIECE SOLID GOLF BALL

CROSS-REFERENCE TO RELATED APPLICATION

This non-provisional application claims priority under 35 U.S.C. § 119(a) on Patent Application No. 2019-088999 filed in Japan on May 9, 2019, the entire contents of which are hereby incorporated by reference.

TECHNICAL FIELD

The present invention relates to a golf ball of five or more layers that has a core, an intermediate layer, an envelope layer consisting of two layers—an inner envelope layer and an outer envelope layer, an intermediate layer and a cover.

BACKGROUND ART

Numerous innovations have been introduced in designing golf balls with a multilayer construction and many such balls have been developed to satisfy the needs of not only professional golfers and skilled amateurs, but also amateur golfers having mid or low head speeds. For example, functional multi-piece solid golf balls in which the surface hardnesses of the respective layers the core, the envelope layer, the intermediate layer and the cover (outermost layer)—have been optimized are widely used.

Examples of such multi-piece solid golf balls include those described in the following patent publications: JP-A 2014-132955, JP-A 2015-173860, JP-A 2016-16117 and JP-A 2016-179052. These publicly disclosed golf balls satisfy the following hardness relationship among the layers: surface hardness of ball>surface hardness of intermediate layer>surface hardness of envelope layer<surface hardness of core, and impart an excellent flight performance even when played by amateur golfers who do not have a high head speed.

Other golf balls with a multilayer structure that are targeted at the ordinary amateur golfer are disclosed in, for example, JP-A 2001-017569, JP-A 2001-017570 and JP-A 2018-148990.

However, the core hardness profile and the thickness relationship among the layers are not fully optimized in any of the above prior-art golf balls. Hence, among manufactured balls targeted at low-head-speed golfers, there remains room for improvement in obtaining an even better flight performance and a good feel at impact.

SUMMARY OF THE INVENTION

It is therefore an object of the present invention to provide a multi-piece solid golf ball for amateur golfers which has an excellent flight when hit by golfers whose head speed is not that high and which also has a good, soft feel at impact.

As a result of extensive investigations, we have discovered that, in a multi-layer solid golf ball having a core, an envelope layer, an intermediate layer and a cover, by forming the envelope layer as two layers—an inner envelope layer and an outer envelope layer—and by producing the golf ball in such a way that the relationship among the surface hardnesses of these layers satisfies the following condition:

surface hardness of inner envelope layer-encased sphere<surface hardness of outer envelope layer-encased sphere<surface hardness of intermediate layer-encased sphere<surface hardness of ball, a good flight performance can be obtained when the ball is hit with a driver (W #1) by golfers lacking a fast head speed, in addition to which a good, soft feel that is not too hard can be achieved.

Accordingly, the invention provides a multi-piece solid golf ball having a core, an envelope layer, an intermediate layer and a cover, wherein the envelope layer is formed into two layers—an inner envelope layer and an outer envelope layer; the sphere obtained by encasing the core with the inner envelope layer (inner envelope layer-encased sphere), the sphere obtained by encasing the inner envelope layer-encased sphere with the outer envelope layer (outer envelope layer-encased sphere), the sphere obtained by encasing the outer envelope layer-encased sphere with the intermediate layer (intermediate layer-encased sphere) and the ball have respective surface hardnesses which together satisfy the following relationship:

surface hardness of inner envelope layer-encased sphere<surface hardness of outer envelope layer-encased sphere<surface hardness of intermediate layer-encased sphere<surface hardness of ball;

and the inner envelope layer or outer envelope layer is formed primarily of one or more thermoplastic elastomer selected from the group consisting of polyester elastomers, polyamide elastomers, polyurethane elastomers, olefin elastomers and styrene elastomers.

In a preferred embodiment of the multi-layer solid golf ball of the invention, both the inner envelope layer and the outer envelope layer are formed primarily of one or more thermoplastic elastomer selected from the group consisting of polyester elastomers, polyamide elastomers, polyurethane elastomers, olefin elastomers and styrene elastomers.

In another preferred embodiment of the inventive golf ball, the core has a hardness profile in which, letting Cc be the Shore C hardness at a center of the core, Cs be the Shore C hardness at a surface of the core, $C_M$ be the Shore C hardness at a midpoint M between the center and surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface and $C_{M-2.5}$, $C_{M-5.0}$ and $C_{M-7.5}$ be the respective Shore C hardnesses at positions 2.5 mm, 5.0 mm and 7.5 mm from the midpoint M toward the core center, the following surface areas A to F:

surface area A: $\frac{1}{2}\times 2.5\times(C_{M-5.0}-C_{M-7.5})$
surface area B: $\frac{1}{2}\times 2.5\times(C_{M-2.5}-C_{M-5.0})$
surface area C: $\frac{1}{2}\times 2.5\times(C_{M}-C_{M-2.5})$
surface area D: $\frac{1}{2}\times 2.5\times(C_{M+2.5}-C_{M})$
surface area E: $\frac{1}{2}\times 2.5\times(C_{M+5}-C_{M+2.5})$
surface area F: $\frac{1}{2}\times 2.5\times(C_{M+7.5}-C_{M+5})$
satisfy the condition (surface area $D$+surface area $E$+surface area $F$)−(surface area $A$+surface area $B$+surface area $C$)>0.

In this preferred embodiment, surface areas A to F in the core hardness profile may satisfy the condition (surface area $D$+surface area $E$)−(surface area $A$+surface area $B$+surface area $C$)≥0.

In the same preferred embodiment, surface areas A to F in the core hardness profile may satisfy the condition $0.15\leq[(\text{surface area } D+\text{surface area } E+\text{surface area } F)-(\text{surface area } A+\text{surface area } B+\text{surface area } C)]/(Cs-Cc)\leq 0.60$.

In yet another preferred embodiment, a coating layer is formed on a surface of the cover and, letting the Shore C hardness of the coating layer be Hc, the difference Hc−Cc between Hc and the Shore C hardness Cc at a center of the core is at least −5 and not more than 20.

In still another preferred embodiment, the ball has from 250 to 370 dimples on the surface thereof, the dimples are of three or more types, the dimple coverage SR, defined as the proportion of the spherical surface of the golf ball accounted for by the dimples, is at least 75%, and the ball when struck has a coefficient of lift CL at a Reynolds number of 70,000 and a spin rate of 2,000 rpm which is at least 70% of the coefficient of lift CL at a Reynolds number of 80,000 and a spin rate of 2,000 rpm.

In a further preferred embodiment, the ball has dimples on the surface thereof, the dimples are of non-spherical shape and the ball surface has a land thereon that is surrounded by a plurality of the non-spherical dimples, which land has a shape that includes at least one vertex, is contiguous at substantially a point with each of at least two neighboring lands and has a surface area in the range of 0.05 to 16.00 $mm^2$.

Advantageous Effects of the Invention

The multi-piece solid golf ball of the invention has an excellent flight when struck by golfers whose head speeds are not that fast, and moreover has a good, soft feel at impact. Such qualities make this ball highly suitable as a golf ball for amateur golfers.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
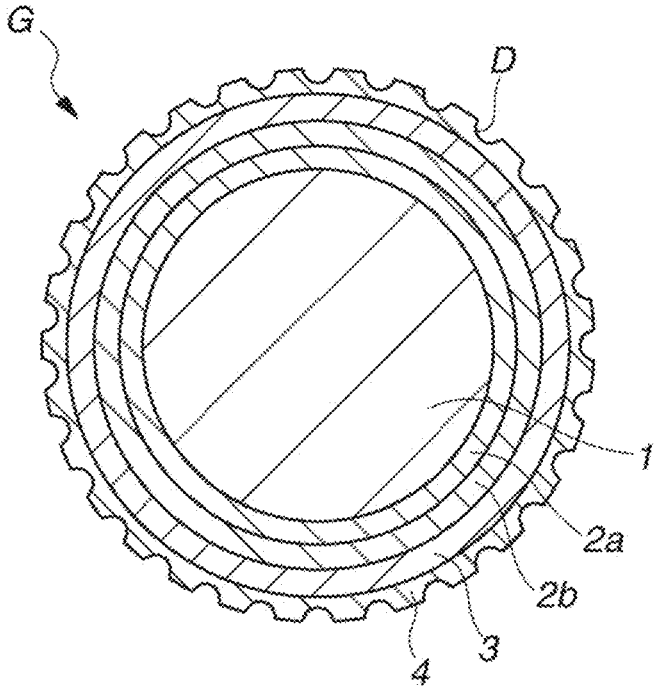
FIG. 1 is a schematic cross-sectional view of the multi-piece solid golf ball according to the invention.

The multi-piece solid golf ball of the invention is, as shown in FIG. 1, a multilayer golf ball G having five or more layers that include a core 1, an inner envelope layer 2*a* encasing the core 1, an outer envelope layer 2*b* encasing the inner envelope layer 2*a*, an intermediate layer 3 encasing the outer envelope layer 2*b*, and a cover 4 encasing the intermediate layer 3. Numerous dimples D are typically formed on the surface of the cover 4. Although not shown in the diagram, a coating layer is generally formed on the surface of the cover 4. Excluding the coating layer, the cover 4 is situated as the outermost layer in the layered structure of the golf ball. The core 1, the intermediate layer 3 and the cover 4 each are not limited to a single layer and may be formed of a plurality of two or more layers. The above layers are described in detail below.

The core has a diameter which is preferably at least 35.0 mm, more preferably at least 35.3 mm, and even more preferably at least 35.6 mm. The core diameter is preferably not more than 36.6 mm, more preferably not more than 36.3 mm, and even more preferably not more than 36.0 mm. When the core diameter is too small, the spin rate on shots with a driver (W #1) may rise, as a result of which the intended distance may not be obtained. On the other hand, when the core diameter is too large, the durability to repeated impact may worsen or the ball may have a poor feel at impact.

The core has a deflection when compressed under a final load of 1,275 N (130 kgf) from an initial load of 98 N (10 kgf) which, although not particularly limited, is preferably at least 3.0 mm, more preferably at least 3.5 mm, and even more preferably at least 4.0 mm. The upper limit is preferably not more than 7.0 mm, more preferably not more than 6.0 mm, and even more preferably not more than 5.0 mm. When the core deflection is too small, i.e., when the core is too hard, the spin rate of the ball may rise excessively, resulting in a poor distance, or the feel at impact may be too hard. On the other hand, when the core deflection is too large, i.e., when the core is too soft, the ball rebound may be too low, resulting in a poor distance, the feel at impact may be too soft, or the durability to cracking on repeated impact may worsen.

The core material is made primarily of a rubber material. Specifically, a rubber composition can be prepared using a base rubber as the primary ingredient and blending with this other ingredients such as a co-crosslinking agent, an organic peroxide, an inert filler and an organosulfur compound. It is preferable to use a polybutadiene as the base rubber.

Commercial products may be used as the polybutadiene. Illustrative examples include BR01, BR51 and BR730 (all products of JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

Examples of co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 5 parts by weight, preferably at least 9 parts by weight, and more preferably at least 13 parts by weight. The amount included is typically not more than 60 parts by weight, preferably not more than 50 parts by weight, and more preferably not more than 40 parts by weight. Too much may make the core too hard, giving the ball an unpleasant feel at impact, whereas too little may lower the rebound.

Commercial products may be used as the organic peroxide. Examples of such products that may be suitably used include Percumyl® D, Perhexa® C-40 and Perhexa® 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.6 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

Another compounding ingredient typically included with the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 5 parts by weight. The upper limit is preferably not more than 50 parts by weight, more preferably not more than 40 parts by weight, and even more preferably not more than 35 parts by weight. Too much or too little inert filler may make it impossible to obtain a proper weight and a suitable rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). One of these may be used alone, or two or more may be used together.

The amount of antioxidant included per 100 parts by weight of the base rubber is set to 0 part by weight or more, preferably at least 0.05 part by weight, and more preferably at least 0.1 part by weight. The upper limit is set to preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound may be included in the core in order to impart a good resilience. The organosulfur compound is not particularly limited, provided it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The zinc salt of pentachlorothiophenol is especially preferred.

The amount of organosulfur compound included per 100 parts by weight of the base rubber is 0 part by weight or more, and it is recommended that the amount be preferably at least 0.05 part by weight, and even more preferably at least 0.1 part by weight, and that the upper limit be preferably not more than 5 parts by weight, more preferably not more than 3 parts by weight, and even more preferably not more than 2.5 parts by weight. Including too much organosulfur compound may make a greater rebound-improving effect (particularly on shots with a W #1) unlikely to be obtained, may make the core too soft or may worsen the feel of the ball at impact. On the other hand, including too little may make a rebound-improving effect unlikely.

Decomposition of the organic peroxide within the core formulation can be promoted by the direct addition of water (or a water-containing material) to the core material. The decomposition efficiency of the organic peroxide within the core-forming rubber composition is known to change with temperature; starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties at the core center.

The water included in the core material is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

The core can be produced by vulcanizing and curing the rubber composition containing the above ingredients. For example, the core can be produced by using a Banbury mixer, roll mill or other mixing apparatus to intensively mix the rubber composition, subsequently compression molding or injection molding the mixture in a core mold, and curing the resulting molded body by suitably heating it under conditions sufficient to allow the organic peroxide or co-crosslinking agent to act, such as at a temperature of between 100 and 200° C., preferably between 140 and 180° C., for 10 to 40 minutes.

The core may consist of a single layer alone, or may be formed as a two-layer core consisting of an inner core layer and an outer core layer. When the core is formed as a two-layer core consisting of an inner core layer and an outer core layer, the inner core layer and outer core layer materials may each be composed primarily of the above-described rubber material. The rubber material making up the outer core layer encasing the inner core layer may be the same as or different from the inner core layer material. The details here are the same as those given above for the ingredients of the core-forming rubber material.

Next, the core hardness profile is described. In the explanation below, core hardnesses signify Shore C hardnesses. These Shore C hardnesses are hardness values measured with a Shore C durometer in general accordance with ASTM D2240.

The core has a center hardness (Cc) which is preferably at least 50, more preferably at least 52, and even more preferably at least 54. The upper limit is preferably not more than 59, more preferably not more than 57, and even more preferably not more than 55. When this value is too large, the feel at impact may harden, or the spin rate on full shots may rise, as a result of which the intended distance may not be achieved. On the other hand, when this value is too small, the rebound may become lower and a good distance may not be achieved, or the durability to cracking under repeated impact may worsen.

The core has a hardness at a position 2.5 mm from the core center (C2.5) which is preferably at least 51, more preferably at least 53, and even more preferably at least 55. The upper limit is preferably not more than 61, more preferably not more than 59, and even more preferably not more than 57. When this value is too small, the rebound may become lower and a good distance may not be achieved, or the durability to cracking on repeated impact may worsen. On the other hand, when this value is too large, the feel at impact may harden, or the spin rate on full shots may rise, as a result of which the intended distance may not be achieved.

The core has a hardness at a position 5 mm from the core center (C5) which is preferably at least 54, more preferably at least 56, and even more preferably at least 58. The upper limit is preferably not more than 63, more preferably not more than 61, and even more preferably not more than 59. Hardnesses outside of this range may lead to undesirable results similar to those described above for the hardness at a position 2.5 mm from the core center (C2.5).

The core has a hardness at a position 7.5 mm from the core center (C7.5) which is preferably at least 56, more preferably at least 58, and even more preferably at least 60. The upper limit is preferably not more than 65, more preferably not more than 63, and even more preferably not more than 61. Hardnesses outside of this range may lead to undesirable results similar to those described above for the hardness at a position 2.5 mm from the core center (C2.5).

The core has a hardness at a position 10 mm from the core center (C10) which is preferably at least 59, more preferably at least 61, and even more preferably at least 63. The upper limit is preferably not more than 68, more preferably not more than 66, and even more preferably not more than 64. Hardnesses outside of this range may lead to undesirable results similar to those described above for the hardness at a position 2.5 mm from the core center (C2.5).

The core has a hardness at a position 12.5 mm from the core center (C7.5) which is preferably at least 64, more preferably at least 66, and even more preferably at least 68. The upper limit is preferably not more than 75, more preferably not more than 73, and even more preferably not more than 71. Hardnesses outside of this range may lead to undesirable results similar to those described above for the hardness at a position 2.5 mm from the core center (C2.5).

The core has a hardness at a position 15 mm from the core center (C15) which is preferably at least 69, more preferably at least 71, and even more preferably at least 73. The upper limit is preferably not more than 81, more preferably not more than 79, and even more preferably not more than 77. Hardnesses outside of this range may lead to undesirable results similar to those described above for the hardness at a position 2.5 mm from the core center (C2.5).

The core has a surface hardness (Cs) which is preferably at least 73, more preferably at least 75, and even more preferably at least 77. The upper limit is preferably not more than 85, more preferably not more than 83, and even more preferably not more than 81. A core surface hardness outside of this range may lead to undesirable results similar to those described above for the core center hardness (Cc).

The difference between the core surface hardness (Cs) and the core center hardness (Cc) is preferably at least 22, more preferably at least 23, and even more preferably at least 24. The upper limit is preferably not more than 35, more preferably not more than 32, and even more preferably not more than 28. When this value is too small, the ball spin rate-lowering effect on shots with a driver may be inadequate, resulting in a poor distance. When this value is too large, the initial velocity of the ball when struck may decrease, resulting in a poor distance, or the durability to cracking on repeated impact may worsen.

Figure 2:
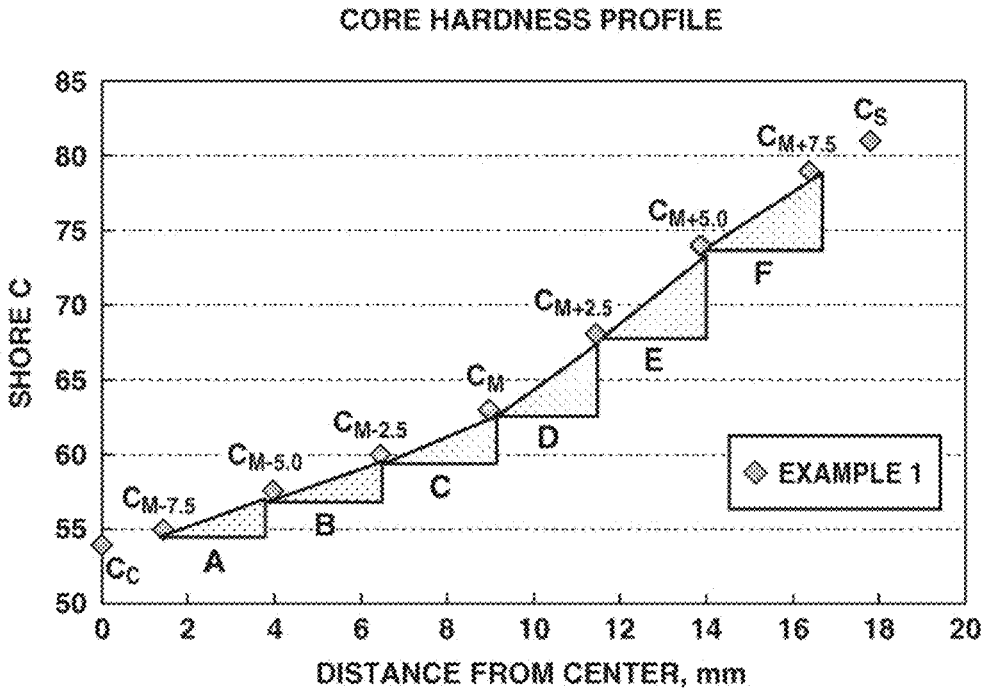
FIG. 2 is a graph that uses core hardness profile data from Example 1 to explain surface areas A to F in the core hardness profile.

In the above core hardness profile in this invention, letting Cc be the Shore C hardness at the core center, Cs be the Shore C hardness at the core surface, $C_M$ be the Shore C hardness at a midpoint M between the center and the surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface and $C_{M-2.5}$, $C_{M-5.0}$ and $C_{M-7.5}$ be the respective Shore C hardnesses at positions 2.5 mm, 5.0 mm and 7.5 mm from the midpoint M toward the core center, the following surface areas A to F:

surface area A: $\frac{1}{2}\times 2.5\times(C_{M-5.0}-C_{M-7.5})$
surface area B: $\frac{1}{2}\times 2.5\times(C_{M-2.5}-C_{M-5.0})$
surface area C: $\frac{1}{2}\times 2.5\times(C_{M}-C_{M-2.5})$
surface area D: $\frac{1}{2}\times 2.5\times(C_{M+2.5}-C_{M})$
surface area E: $\frac{1}{2}\times 2.5\times(C_{M+5}-C_{M+2.5})$
surface area F: $\frac{1}{2}\times 2.5\times(C_{M+7.5}-C_{M+5})$ are preferably such that the value of (surface area D+surface area E+surface area F) −(surface area A+surface area B+surface area C) satisfies the specific range described below. FIG. 2 shows a graph that uses core hardness profile data from Example 1 to explain surface areas A to F. Each of surface areas A to F is the surface area of a triangle whose base is the difference between specific distances in the core cross-section and whose height is the difference in hardness between positions at these specific distances.

The value of (surface area D+surface area E+surface area F)−(surface area A+surface area B+surface area C) above is preferably more than 0, more preferably at least 3, and even more preferably at least 6. Although not particularly limited, this value is preferably not more than 20, more preferably not more than 15, and even more preferably not more than 10. When this value is too small, the spin rate lowering effect on shots with a driver (W #1) may be inadequate, as a result of which a good distance may not be achieved. When this value is too large, the initial velocity of the ball when struck may become lower, resulting in a poor distance, or the durability to cracking on repeated impact may worsen.

In the above core hardness profile, it is preferable for the following condition to be satisfied:

$$0.15\leq[(\text{surface area } D+\text{surface area } E+\text{surface area } F)-(\text{surface area } A+\text{surface area } B+\text{surface area } C)]/(Cs-Cc)\leq 0.60.$$

The lower limit value here is preferably at least 0.20, and more preferably at least 0.25. The upper limit value in this formula is preferably not more than 0.50, and more preferably not more than 0.40. When this value is too small, the spin rate-lowering effect on shots with a driver (W #1) may be inadequate and so a good distance may not be achieved. On the other hand, when this value is too large, the initial velocity of the ball when struck may be low, resulting in a poor distance, or the durability to cracking on repeated impact may worsen.

In addition, in the above core hardness profile, it is preferable for the following condition to be satisfied:

$$(\text{surface area } D+\text{surface area } E)-(\text{surface area } A+\text{surface area } B+\text{surface area } C)\geq 0.$$

The lower limit value here is preferably at least 0.5, and more preferably at least 1.0. The upper limit value is preferably not more than 8.0, more preferably not more than 6.0, and even more preferably not more than 4.0. When this value is too small, the spin rate-lowering effect on shots with a driver (W #1) may be inadequate, and so a good distance may not be achieved. On the other hand, when this value is too large, the initial velocity of the ball when struck may become lower, resulting in a poor distance, or the durability to cracking on repeated impact may worsen.

Next, the envelope layer is described.

In this invention, the envelope layer is formed of two layers: an inner layer and an outer layer. These are referred to below as, respectively, the inner envelope layer and the outer envelope layer.

The inner envelope layer has a material hardness on the Shore D scale which, although not particularly limited, is preferably at least 15, more preferably at least 20, and even more preferably at least 25. The upper limit is preferably not more than 39, more preferably not more than 37, and even more preferably not more than 35. The sphere obtained by encasing the core with the inner envelope layer (inner envelope layer-encased sphere) has a surface hardness on the Shore D scale which is preferably at least 23, more preferably at least 28, and even more preferably at least 33. The upper limit is preferably not more than 49, more preferably not more than 47, and even more preferably not more than 45. When the material hardness and surface hardness of the inner envelope layer are lower than the above ranges, the spin rate of the ball on full shots may rise excessively, as a result of which a good distance may not be achieved, and the durability to cracking on repeated impact may worsen. On the other hand, when the material hardness and surface hardness are too high, the durability to cracking on repeated impact may worsen or the spin rate on full shots may rise and a good distance may not be obtained. At low head speeds in particular, a good distance may not be obtained or the feel at impact may worsen.

The inner envelope layer has a thickness which is preferably at least 0.4 mm, more preferably at least 0.55 mm, and even more preferably at least 0.7 mm. The upper limit in the thickness of the inner envelope layer is preferably not more than 1.3 mm, more preferably not more than 1.1 mm, and even more preferably not more than 0.9 mm. When the inner envelope layer is thinner than the above range, the durability to cracking on repeated impact may worsen or the feel at impact may worsen. On the other hand, when the inner envelope layer is thicker than this range, the spin rate of the ball on full shots may increase and a good distance may not be obtained.

The outer envelope layer has a material hardness on the Shore D scale which, although not particularly limited, is preferably at least 33, more preferably at least 36, and even more preferably at least 38. The upper limit is preferably not more than 50, more preferably not more than 47, and even more preferably not more than 45. The sphere obtained by encasing the inner envelope layer-encased sphere with the outer envelope layer (outer envelope layer-encased sphere) has a surface hardness on the Shore D scale which is preferably at least 39, more preferably at least 42, and even more preferably at least 44. The upper limit is preferably not more than 56, more preferably not more than 53, and even more preferably not more than 51. When the material hardness and surface hardness of the outer envelope layer are lower than the above ranges, the spin rate of the ball on full shots may rise, as a result of which a sufficient distance may not be achieved, or the durability to cracking on repeated impact may worsen. On the other hand, when the material hardness and surface hardness are too high, the durability to cracking on repeated impact may worsen or the spin rate on full shots may rise, resulting in a poor distance, or the feel at impact may worsen.

The outer envelope layer has a thickness which is preferably at least 0.4 mm, more preferably at least 0.55 mm, and even more preferably at least 0.7 mm. The upper limit in the thickness of the outer envelope layer is preferably not more than 1.3 mm, more preferably not more than 1.1 mm, and even more preferably not more than 0.9 mm. When the outer envelope layer thickness is thinner than the above range, the durability to cracking on repeated impact may worsen, or the feel at impact may worsen.

The overall thickness of the envelope layer, i.e., the sum of the thicknesses of the inner envelope layer and the outer envelope layer, is preferably at least 1.0 mm, more preferably at least 1.2 mm, and even more preferably at least 1.4 mm. On the other hand, the upper limit in the overall thickness of the envelope layer is preferably not more than 2.8 mm, even more preferably not more than 2.4 mm, and still more preferably not more than 2.0 mm. When the overall thickness of the envelope layer is smaller than this range, the durability to cracking on repeated impact may worsen, or the feel at impact may worsen. On the other hand, when the overall thickness of the envelope layer is larger than this range, the spin rate of the ball on full shots may rise, possibly resulting in a poor distance.

In the golf ball of the present invention, the envelope layer materials are formed primarily of one or more thermoplastic elastomer selected from the group consisting of polyester elastomers, polyamide elastomers, polyurethane elastomers, olefin elastomers and styrene elastomers. Of these, from the standpoint of obtaining a good rebound within the desired hardness ranges, the use of polyester-based thermoplastic elastomers such as thermoplastic polyether ester elastomers is preferred. The respective materials for the inner envelope layer and the outer envelope layer may be the same or different, so long as each such material falls within the above range of resin materials.

Next, the intermediate layer is described.

The intermediate layer has a material hardness on the Shore D scale which, although not particularly limited, is preferably at least 44, more preferably at least 47, and even more preferably at least 50. The upper limit is preferably not more than 62, more preferably not more than 60, and even more preferably not more than 58. The sphere obtained by encasing the outer envelope layer-encased sphere with the intermediate layer (intermediate layer-encased sphere) has a surface hardness on the Shore D scale which is preferably at least 50, more preferably at least 53, and even more preferably at least 56. The upper limit is preferably not more than 68, more preferably not more than 66, and even more preferably not more than 64. When the material hardness and surface hardness of the intermediate layer are lower than the above ranges, the spin rate of the ball on full shots may rise excessively, as a result of which a good distance may not be achieved, or the durability to cracking on repeated impact may worsen. On the other hand, when the material hardness and surface hardness are too high, the durability to cracking on repeated impact may worsen or the spin rate on full shots may rise, resulting in a poor distance, and the feel at impact may worsen.

The intermediate layer has a thickness which is preferably at least 0.4 mm, more preferably at least 0.55 mm, and even more preferably at least 0.7 mm. The upper limit is preferably not more than 1.4 mm, more preferably not more than 1.2 mm, and even more preferably not more than 1.0 mm. When the intermediate layer thickness is smaller than the above range, the durability to cracking on repeated impact may worsen, or the feel at impact may worsen. On the other hand, when the thickness of the intermediate layer is higher than the above range, the spin rate of the ball on full shots may rise and a good distance may not be achieved.

The material making up the intermediate layer is not particularly limited; known resins may be used for this purpose. Examples of preferred materials include resin compositions containing as the essential ingredients:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer mixed with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (B) a non-ionomeric thermoplastic elastomer in a weight ratio between 100:0 and 50:50;

(C) from 5 to 120 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D in the intermediate layer-forming resin material described in, for example, JP-A 2010-253268 may be advantageously used as above components A to D.

A non-ionomeric thermoplastic elastomer may be included in the intermediate layer material. The non-ionomeric thermoplastic elastomer is preferably included in an amount of from 0 to 50 parts by weight per 100 parts by weight of the total amount of the base resin.

Exemplary non-ionomeric thermoplastic elastomers include polyolefin elastomers (including polyolefins and metallocene polyolefins), polystyrene elastomers, diene polymers, polyacrylate polymers, polyamide elastomers, polyurethane elastomers, polyester elastomers and polyacetals.

Optional additives may be suitably included in the above resin materials. For example, pigments, dispersants, antioxidants, ultraviolet absorbers and light stabilizers may be added. When these additives are included, the amount added per 100 parts by weight of the overall base resin is preferably at least 0.1 part by weight, and more preferably at least 0.5 part by weight. The upper limit is preferably not more than 10 parts by weight, and more preferably not more than 4 parts by weight.

Next, the cover is described.

The cover has a material hardness on the Shore D scale which, although not particularly limited, is preferably at least 55, more preferably at least 59, and even more preferably at least 61. The upper limit is preferably not more than 70, more preferably not more than 68, and even more preferably not more than 65. The surface hardness of the sphere obtained by encasing the intermediate layer-encased sphere with the cover (i.e., the ball), expressed on the Shore D scale, is preferably at least 61, more preferably at least 65, and even more preferably at least 67. The upper limit is preferably not more than 76, more preferably not more than 74, and even more preferably not more than 71. When the material hardness of the cover and the surface hardness of the ball are too much lower than the above respective ranges, the spin rate of the ball on shots with a driver (W #1) may rise and the ball initial velocity may decrease, as a result of which a good distance may not be achieved. On the other hand, when the material hardness of the cover and the surface hardness of the ball are too high, the durability to cracking on repeated impact may worsen.

The cover has a thickness of preferably at least 0.6 mm, more preferably at least 0.8 mm, and even more preferably at least 1.0 mm. The upper limit in the cover thickness is preferably not more than 1.4 mm, more preferably not more than 1.2 mm, and even more preferably not more than 1.1 mm. When the cover is too thin, the durability to cracking on repeated impact may worsen. On the other hand, when the cover is too thick, the spin rate on shots with a driver (W #1) may become too high and a good distance may not be achieved, or the feel at impact in the short game and on shots with a putter may become too hard.

Various types of thermoplastic resins that are used as golf ball cover stock, especially ionomeric resins, may be suitably employed as the cover material. A commercial product may be used as the ionomeric resin. Alternatively, the cover-forming resin material that is used may be one obtained by blending, of commercially available ionomeric resins, a high-acid ionomeric resin having an acid content of at least 18 wt % with a conventional ionomeric resin. The high rebound and spin rate-lowering effect obtained with such a blend make it possible to achieve a good distance on shots with a driver (W #1). The amount of such a high-acid ionomeric resin per 100 wt % of the resin material is preferably at least 10 wt %, more preferably at least 30 wt %, and even more preferably at least 60 wt %. The upper limit is typically 100 wt % or less, preferably 90 wt % or less, and more preferably 80 wt % or less. When the content of this high-acid ionomeric resin is too low, the spin rate on shots with a driver (W #1) may become too high and a good distance may not be achieved. On the other hand, when the content of the high-acid ionomeric resin is too high, the durability to cracking on repeated impact may worsen.

The sphere obtained by encasing the intermediate layer-encased sphere with the cover (i.e., the overall ball) has a deflection when compressed under a final load of 1,275 N (130 kgf) from an initial load of 98 N (10 kgf) which, although not particularly limited, is preferably at least 2.6 mm, more preferably at least 2.9 mm, and even more preferably at least 3.2 mm. The upper limit is preferably not more than 4.8 mm, more preferably not more than 4.3 mm, and even more preferably not more than 3.8 mm. When the deflection of this sphere is too small, i.e., when the sphere is too hard, the spin rate of the ball may rise excessively and thus not achieve a good distance, or the feel at impact may become too hard. On the other hand, when the deflection of this sphere is too large, i.e., when the sphere is too soft, the ball may have too low a rebound and thus not achieve a good distance, the feel at impact may be too soft, or the durability to cracking on repeated impact may worsen.

The inventive golf ball of at least five layers having the above-described core, inner envelope layer, outer envelope layer, intermediate layer and cover (outermost layer) can be manufactured by a customary method such as a known injection molding process. For example, a golf ball having at least a five-layer construction can be produced by successively injection-molding the inner envelope layer material, outer envelope layer material and intermediate layer material over the core with injection molds for the respective layers so as to obtain the respective layer-encased spheres and then, last of all, injection-molding the material for the cover serving as the outermost layer over the intermediate layer-encased sphere. Alternatively, the encasing layers may each be formed by enclosing the sphere to be encased within two half-cups that have been pre-molded into hemispherical shapes and then molding under applied heat and pressure.

Hardness Relationships Among Layers

In this invention, it is critical for the hardness relationship among the layers to satisfy the following formula:

surface hardness of inner envelope layer-encased sphere<surface hardness of outer envelope layer-encased sphere<surface hardness of intermediate layer-encased sphere<surface hardness of ball.

When this hardness relationship is not satisfied, a good flight as well as a feel at impact that is soft and yet solid may not be achievable at both mid and low head speeds.

As indicated in the above formula, the ball has a surface hardness which is larger than the surface hardness of the intermediate layer-encased sphere. This hardness difference, in terms of Shore D hardness, is preferably from 1 to 16, more preferably from 3 to 14, and even more preferably from 5 to 12. When this difference is small, the spin rate-lowering effect on full shots may be inadequate and a good distance may not be achieved. On the other hand, when this difference is too large, the durability to cracking on repeated impact may worsen.

As indicated in the above formula, the intermediate layer-encased sphere has a surface hardness which is larger than the surface hardness of the outer envelope layer-encased sphere. This hardness difference, in terms of Shore D hardness, is preferably from 1 to 21, more preferably from 5 to 19, and even more preferably from 9 to 17. When this difference is small, a feel at impact that is both soft and solid may not be achievable. On the other hand, when this difference is too large, the durability to cracking on repeated impact may worsen.

As indicated in the above formula, the outer envelope layer-encased sphere has a surface hardness which is larger than the surface hardness of the inner envelope layer-encased sphere. This hardness difference, in terms of Shore D hardness, is preferably from 2 to 25, more preferably from 5 to 18, and even more preferably from 8 to 13. When this difference is small, a feel at impact that is both soft and solid may not be achievable. On the other hand, when this difference is large, the durability to cracking on repeated impact may worsen.

It is preferable for the inner envelope layer-encased sphere to have a surface hardness which is larger than the center hardness of the core. The value obtained by subtracting the center hardness of the core from the surface hardness of the inner envelope layer-encased sphere, in terms of Shore D hardness, is preferably from 2 to 25, more preferably from 5 to 18, and even more preferably from 8 to 13. When this difference is small, the spin rate on full shots may rise and a good distance may not be achieved. On the other hand, when this difference is large, the durability to cracking on repeated impact may worsen.

Also, it is preferable for the surface hardness of the outer envelope layer-encased sphere to be larger than the surface hardness of the core. The value obtained by subtracting the surface hardness of the core from the surface hardness of the outer envelope layer-encased sphere, in terms of Shore D hardness, is preferably from 0 to 15, more preferably from 2 to 10, and even more preferably from 4 to 7. When this difference is small, the spin rate on full shots may rise and a good distance may not be achieved. On the other hand, when this difference is large, the durability to cracking on repeated impact may worsen.

Thickness Relationships Among Layers

In this invention, although not particularly limited, it is desirable to design the thicknesses of the various layers in such a way that the combined thickness of the inner envelope layer and the outer envelope layer, i.e., the total thickness of the envelope layer, is smaller than the combined thickness of the intermediate layer and the cover. In this case the value expressed as (combined thickness of intermediate layer and cover)−(overall thickness of envelope layer) is preferably from 0.1 to 1.2 mm, more preferably from 0.3 to 1.0 mm, and even more preferably from 0.5 to 0.8 mm. When this value is too small, the spin rate of the ball may rise and a good distance may not be achieved. On the other hand, when this value is too large, the feel at impact may be hard and unpleasant.

The value obtained by subtracting the intermediate layer thickness from the cover thickness is preferably from −0.4 to 0.7 mm, more preferably from −0.2 to 0.4 mm, and even more preferably from 0 to 0.2 mm. When this value is too small, the durability to cracking on repeated impact may worsen. On the other hand, when this value is too large, the spin rate of the ball may rise and a good distance may not be obtained.

Numerous dimples may be formed on the outside surface of the cover (outermost layer). The number of dimples arranged on the outside surface of the cover is preferably at least 250, more preferably at least 270, and even more preferably at least 300. The upper limit is preferably not more than 370, more preferably not more than 350, and even more preferably not more than 340. When the number of dimples is higher than this range, the ball trajectory may become lower and the distance traveled by the ball may decrease. On the other hand, when the number of dimples is lower that this range, the ball trajectory may become higher and an increased distance may not be achieved.

The dimple shapes used may be of one type or may be a combination of two or more types suitably selected from among, for example, circular shapes and oval shapes, various polygonal shapes, dewdrop shapes as well other non-circular shapes. When circular dimples are used, the dimple diameter may be set to from about 2.5 mm to about 6.5 mm, and the dimple depth may be set to from 0.08 mm and up to 0.30 mm.

In order for the aerodynamic properties of the dimples to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to from 60 to 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to from 0.35 to 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to from 0.6% to 1.0%. Outside of the above ranges in these respective values, the resulting trajectory may not enable a good distance to be achieved and so the ball may fail to travel a fully satisfactory distance.

Moreover, to obtain the desired distance-increasing effect, it is preferable to suitably adjust the coefficient of drag CD or the coefficient of lift CL, and especially preferable to set the coefficient of drag CD under high-velocity conditions to a low value and the coefficient of lift CL under low-velocity conditions to a high value. Specifically, it is desirable for the coefficient of lift CL when the Reynolds number is 70,000 and the spin rate is 2,000 rpm just prior to the ball reaching the highest point on its trajectory to be held to preferably at least 70%, and more preferably at least 75%, of the coefficient of lift CL shortly before this when the Reynolds number is 80,000 and the spin rate is 2,000 rpm. In addition, it is desirable for the coefficient of drag CD to be 0.225 or less when the Reynolds number is 180,000 and the spin rate is 2,520 rpm immediately after launch of the ball when it is struck.

When the dimple shapes are non-circular, the following approach can be taken. Two neighboring non-dimple regions on the surface of the ball (which regions are referred to below as "lands") can be made contiguous with each other at vertices thereof Alternatively, lands having substantially concave polygonal shapes can be made contiguous, at some or all vertices thereon, with neighboring lands. The length of the outer periphery of a land can be set to from 1.6 mm to 19.4 mm, and the length of the outer periphery of a dimple can be set to from 3.2 mm to 38.8 mm. The entire surface of the dimple can be made a smooth curved surface. A single dimple may be arranged so as to be contiguous with four or more such lands. A single dimple may be arranged so as to be contiguous with six or fewer such lands. The number of lands may be set to from 434 to 863. The lands may be given shapes that are inscribed within triangles.

To ensure a good ball appearance, it is preferable to apply a clear coating onto the cover surface. The coating composition used for clear coating is preferably one which uses two types of polyester polyol as the base resin and also uses a polyisocyanate as the curing agent. In this case, various organic solvents can be admixed depending on the intended coating conditions. Examples of organic solvents that can be used include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon-based solvents such as mineral spirits.

The coating layer obtained by such clear coating has a hardness on the Shore C hardness scale which is preferably from 40 to 80, more preferably from 47 to 72, and even more preferably from 55 to 65. When this coating layer is too soft, mud may stick to the surface of the ball when used for golfing. On the other hand, when the coating layer is too hard, it may tend to peel off when the ball is struck.

The difference between the coating layer hardness (Hc) and the core center hardness (Cc) on the Shore C hardness scale, expressed as Hc−Cc, is preferably from −5 to 20, more preferably from 0 to 18, and even more preferably from 5 to 15. When the difference falls outside of this range, the spin rate of the ball on full shots may rise, as a result of which a good distance may not be achieved.

The coating layer has a thickness of typically from 9 to 22 μm, preferably from 11 to 20 μm, and more preferably from 13 to 18 μm. When the coating layer is thinner than this range, the cover protecting effect may be inadequate. On the other hand, when the coating layer is thicker than this range, the dimple shapes may no longer be sharp, as a result of which a good distance may not be achieved.

The multi-piece solid golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 4, Comparative Examples 1 to 7

Formation of Core

Solid cores were produced by preparing rubber compositions for the respective Examples and Comparative Examples shown in Table 1, and then molding/vulcanizing the compositions under vulcanization conditions of 155° C. and 15 minutes.

TABLE 1

| Core formulation | Example | | | | Comparative Example | | | | | | |
|---|---|---|---|---|---|---|---|---|---|---|---|
| (pbw) | 1 | 2 | 3 | 4 | 1 | 2 | 3 | 4 | 5 | 6 | 7 |
| Polybutadiene A | 20 | 20 | 20 | 20 | 20 | 20 | 20 | 20 | 20 | 20 | 20 |
| Polybutadiene B | 80 | 80 | 80 | 80 | 80 | 80 | 80 | 80 | 80 | 80 | 80 |
| Zinc acrylate | 37.0 | 34.9 | 37.0 | 34.9 | 37.0 | 37.0 | 37.0 | 37.0 | 37.0 | 37.0 | 37.0 |
| Organic peroxide | 1.0 | 1.0 | 1.0 | 1.0 | 1.0 | 1.0 | 1.0 | 1.0 | 1.0 | 1.0 | 1.0 |
| Water | 0.8 | 0.8 | 0.8 | 0.8 | 0.8 | 0.8 | 0.8 | 0.8 | 0.8 | 0.8 | 0.8 |
| Antioxidant | 0.1 | 0.1 | 0.1 | 0.1 | 0.1 | 0.1 | 0.1 | 0.1 | 0.1 | 0.1 | 0.1 |
| Zinc oxide | 21.3 | 22.1 | 21.3 | 22.1 | 21.3 | 19.8 | 21.3 | 19.1 | 28.5 | 19.1 | 22.2 |
| Zinc salt of pentachlorothiophenol | 1.0 | 1.0 | 1.0 | 1.0 | 1.0 | 1.0 | 1.0 | 1.0 | 1.0 | 1.0 | 1.0 |

Details on the ingredients mentioned in Table 1 are given below.

Polybutadiene A: Available under the trade name "BR 51" from JSR Corporation

Polybutadiene B: Available under the trade name "BR 730" from JSR Corporation

Zinc acrylate: Available as "ZN-DA85S" from Nippon Shokubai Co., Ltd.

Organic Peroxide: Dicumyl peroxide, available under the trade name "Percumyl D" from NOF Corporation Water: Pure water (from Seiki Chemical Industrial Co., Ltd.)

Antioxidant: 2,2-Methylenebis(4-methyl-6-butylphenol), available under the trade name "Nocrac NS-6" from Ouchi Shinko Chemical Industry Co., Ltd.

Zinc oxide: Available as "Zinc Oxide Grade 3" from Sakai Chemical Co., Ltd.

Zinc salt of pentachlorothiophenol:

Available from Wako Pure Chemical Industries, Ltd.

Formation of Inner and Outer Envelope Layers

Next, in each Example and Comparative Example other than Comparative Examples 6 and 7, an inner envelope layer was formed by injection molding the inner envelope layer material of formulation No. 1, 2, 3 or 4 shown in Table 2 over the core, thereby giving an inner envelope layer-encased sphere. An outer envelope layer was subsequently formed by injection molding the outer envelope layer material of formulation No. 1, 2, 3, 5 or 6 shown in the same table, thereby giving an outer envelope layer-encased sphere. In Comparative Examples 6 and 7, the envelope layer was substantially a single layer, and so the sphere obtained here was a single envelope layer-encased sphere.

Formation of Intermediate Layer

Next, in each Example and Comparative Example, a single intermediate layer having a thickness of 1.0 mm was formed by injection molding the intermediate layer material having formulation No. 7, 8 or 9 in Table 2 over the outer envelope layer-encased sphere (in Comparative Examples 6 and 7, the substantially single envelope layer-encased sphere) obtained in the respective Examples and Comparative Examples, thereby giving an intermediate layer-encased sphere.

Formation of Cover (Outermost Layer)

Next, in each Example and Comparative Example, a cover (outermost layer) having a thickness of 1.1 mm was formed by injection molding the cover material of formulation No. 10 or 11 in Table 2 over the intermediate layer-encased sphere obtained above. A plurality of given dimples common to all the Examples and Comparative Examples were formed at this time on the cover surface. Details on the dimples are subsequently described.

TABLE 2

| Resin composition (pbw) | No. 1 | No. 2 | No. 3 | No. 4 | No. 5 | No. 6 | No. 7 | No. 8 | No. 9 | No. 10 | No. 11 |
|---|---|---|---|---|---|---|---|---|---|---|---|
| Hytrel 3001 | 100 | | | | | | | | | | |
| Hytrel 4001 | | 100 | | | | | | | | | |
| Hytrel 5557 | | | 100 | | | | | | | | |
| Hytrel 4767 | | | | | | 100 | | | | | |
| AN4311 | | | | 100 | | | | | | | |
| N035C | | | | | 100 | | | | | | |
| HPF 2000 | | | | | | | | | 100 | | |
| HPF 1000 | | | | | | | 56 | 100 | | | |
| Himilan 1605 | | | | | | | 44 | | | | |
| Himilan 1557 | | | | | | | | | | | 20 |
| Himilan 1855 | | | | | | | | | | | 30 |
| AM 7318 | | | | | | | | | | 75 | |
| AM 7327 | | | | | | | | | | 25 | |
| Surlyn 8120 | | | | | | | | | | | 50 |
| Titanium oxide | | | | | | | | | | 4.0 | 4.0 |

Trade names of the chief materials in the above table are given below.

Hytrel® 3001, 4001, 5557, 4767:

Polyester elastomers available from DuPont-Toray Co., Ltd.

AN4311, N035C: Available under the trade name Nucrel® from Dow-Mitsui Polychemicals Co., Ltd.

HPF® 2000, HPF® 1000: Available from E.I. DuPont de Nemours & Co.

Himilan®, AM 7318, AM 7327:

Ionomers available from DuPont-Mitsui Polychemicals Co., Ltd.

Surlyn® 8120: An ionomer available from E.I. DuPont de Nemours & Co.

Titanium oxide: Available from Sakai Chemical Industry Co., Ltd.

Dimples

Figure 3:
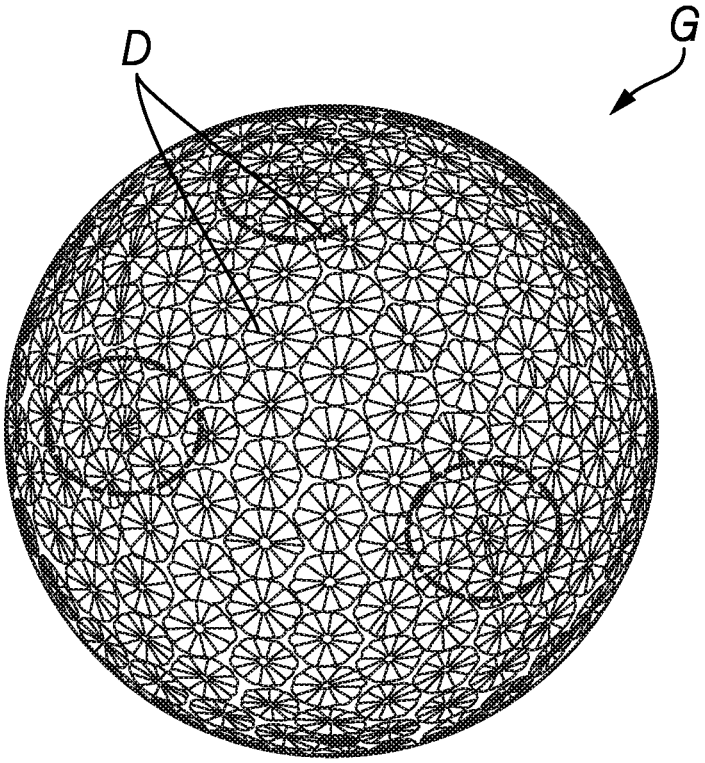
FIG. 3 is a top view of a ball showing the dimples (Type A) used in the Examples and Comparative Examples.

The type A dimples described below were used on the ball surface. Type A dimples are, as shown in FIG. 3, specially shaped dimples surrounded by star-shaped lands. These dimples are made up of a total of 326 dimples consisting of 12 non-circular dimples (No. 1) (three of which are shown surrounded by a circle in FIG. 3) that are each surrounded and formed by five star-shaped lands, and 314 non-circular dimples (No. 2) that are each surrounded and formed by six star-shaped lands. The total number of star-shaped lands is 648. The surface area of the star-shaped lands is from 0.5 to 0.7 $mm^2$ for regions having five star shapes, the average being 0.65 $mm^2$, and is from 0.65 to 1.0 $mm^2$ for regions having six star shapes, the average being 0.9 $mm^2$. Details on the Type A dimples are shown below in Table 3.

TABLE 3

| Dimple details | Type A | |
|---|---|---|
| FIG. | FIG. 3 | |
| Type | No. 1 | No. 2 |
| Shape | non-circular | |
| Number | 12 | 314 |
| Total number of dimples | 326 | |
| SR (%) | 90 | |
| Low-velocity CL ratio (%) | 82 | |
| CD in high-velocity region | 0.17 | |

SR: Sum of individual dimple surface areas, each defined by the flat plane circumscribed by the edge of the dimple, as a percentage of the spherical surface area of the ball were the ball to have no dimples thereon. (units, %)

Low-Velocity CL Ratio:

Ratio of ball coefficient of lift CL at Reynolds number of 70,000 and spin rate of 2,000 rpm with respect to coefficient of lift CL at Reynolds number of 80,000 and spin rate of 2,000 rpm for ball on trajectory just after being launched with Ultra Ball Launcher (UBL). (units, %)

High-Velocity CD:

Coefficient of drag when ball was launched at Reynolds number of 180,000 and spin rate of 2,520 rpm using same apparatus as above.

The UBL is a device manufactured by Automated Design Corporation which includes two pairs of drums, one on top and one on the bottom. The drums are turned by belts across the two top drums and across the two bottom drums. The UBL inserts a golf ball between the turning drums and launches the golf ball under the desired conditions.

Formation of Coating Layer

Next, the coating composition shown in Table 4 below was applied with an air spray gun onto the surface of the cover (outermost layer) on which numerous dimples had been formed, thereby producing golf balls having a 15 μm-thick coating layer formed thereon.

TABLE 4

| | | | |
|---|---|---|---|
| Coating composition I (pbw) | Base resin | Polyol | 29.77 |
| | | Additive | 0.22 |
| | | Solvent | 70.01 |
| | Curing agent | Isocyanate | 42 |
| | | Solvent | 58 |
| Coating layer properties | Shore C hardness | | 62.5 |
| | Thickness (μm) | | 15 |

A polyester polyol synthesized as follows was used as the polyol in the base resin.

A reactor equipped with a reflux condenser, a dropping funnel, a gas inlet and a to thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to between 200 and 240° C. under stirring and the reaction was effected by 5 hours of heating. This yielded a polyester polyol having an acid value of 4, a hydroxyl value of 170 and a weight-average molecular weight (Mw) of 28,000. The additives were water repellent additives. All the additives used were commercial products. Products that were silicone-based additives, stain resistance-improving silicone additives, or fluoropolymers having an alkyl group chain length of 7 or less were added.

The isocyanate used in the curing agent was Duranate™ TPA-100 (from Asahi Kasei Corporation; NCO content, 23.1%; 100% nonvolatiles), an isocyanurate of hexamethylene diisocyanate (HMDI).

Butyl acetate was used as the base resin solvent, and ethyl acetate and butyl acetate were used as the curing agent solvents. The Shore C hardness value in the table was obtained by preparing sheets having a thickness of 2 mm and carrying out measurement with a Shore C durometer in general accordance with ASTM D2240.

Various properties of the resulting golf balls, including the internal hardnesses at various positions in the core, the diameters of the core and the respective layer-encased spheres, the thickness and material hardness of each layer, and the surface hardness of the respective layer-encased spheres, were evaluated by the following methods. The results are presented in Tables 5 and 6.

Diameters of Core, Inner and Outer Envelope Layer-Encased Spheres and Intermediate Layer-Encased Sphere The diameters at five random places on the surface were measured at a temperature of 23.9±1° C. and, using the average of these measurements as the measured value for a single core, inner or outer envelope layer-encased sphere or intermediate layer-encased sphere, the average diameter for ten such spheres was determined.

Ball Diameter

The diameters at 15 random dimple-free areas were measured at a temperature of 23.9±1° C. and, using the average of these measurements as the measured value for a single ball, the average diameter for ten balls was determined.

Core Hardness Profile

The indenter of a durometer was set substantially perpendicular to the spherical surface of the core, and the surface hardness of the core on the Shore C hardness scale was measured in accordance with ASTM D2240. Cross-sectional hardnesses at the center of the core and at given positions in the core were measured by perpendicularly pressing the indenter of a durometer against the place to be measured in the flat cross-section obtained by cutting the core into hemispheres. The measurement results are indicated as Shore C hardness values.

In addition, letting Cc be the Shore C hardness at the core center, Cs be the Shore C hardness at the core surface, $C_M$ be the Shore C hardness at a midpoint M between the core center and surface, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface and $C_{M-2.5}$, $C_{M-5.0}$ and $C_{M-7.5}$ be the respective Shore C hardnesses at positions 2.5 mm, 5.0 mm and 7.5 mm from the midpoint M toward the core center, the surface areas A to F defined as follows surface area A: $\frac{1}{2}\times 2.5\times(C_{M-5.0}-C_{M-7.5})$,
surface area B: $\frac{1}{2}\times 2.5\times(C_{M-2.5}-C_{M-5.0})$,
surface area C: $\frac{1}{2}\times 2.5\times(C_{M}-C_{M-2.5})$,
surface area D: $\frac{1}{2}\times 2.5\times(C_{M+2.5}-C_{M})$,
surface area E: $\frac{1}{2}\times 2.5\times(C_{M+5.0}-C_{M+2.5})$, and
surface area F: $\frac{1}{2}\times 2.5\times(C_{M+7.5}-C_{M+5.0})$ were calculated, and the values of the following three expressions were determined:

(surface area *D*+surface area *E*+surface area *F*)−(surface area *A*+surface area *B*+surface area *C*);

(surface area *D*+surface area *E*)−(surface area *A*+surface area *B*+surface area *C*);

[(surface area *D*+surface area *E*+surface area *F*)−(surface area *A*+surface area *B*+surface area *C*)]/(*Cs*−*Cc*).

Surface areas A to F in the core hardness profile are explained in FIG. 2, which is a graph that illustrates surface areas A to F using the core hardness profile data from Example 1.

Core Deflection

The core was placed on a hard plate and the amount of deflection when compressed under a final load of 1,275 N (130 kgf) from an initial load of 98 N (10 kgf) was measured. The amount of deflection here refers in each case to the measured value obtained after holding the core isothermally at 23.9° C.

Material Hardnesses (Shore D Hardnesses) of Inner and Outer Envelope Layers, Intermediate Layer and Cover The resin material for each of these layers was molded into a sheet having a thickness of 2 mm and left to stand for at least two weeks, following which the Shore D hardness was measured in accordance with ASTM D2240.

Surface Hardnesses (Shore D Hardnesses) of Inner and Outer Envelope Layer-Encased Spheres, Intermediate Layer-Encased Sphere and Ball The surface hardness was measured by perpendicularly pressing an indenter against the surface of the sphere being tested. The surface hardnesses of the balls (covers) were values measured at dimple-free areas (lands) on the surface of the ball. The Shore D hardnesses were measured with a type D durometer in accordance with ASTM D2240.

TABLE 5

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| | Ball construction | 5-piece | 5-piece | 5-piece | 5-piece | 5-piece | 5-piece | 5-piece | 5-piece | 5-piece | 4-piece | 4-piece |
| Core | Diameter (mm) | 35.7 | 35.7 | 35.7 | 35.7 | 35.7 | 35.7 | 35.7 | 35.7 | 35.7 | 35.7 | 35.7 |
| | Weight (g) | 28.4 | 28.4 | 28.4 | 28.4 | 28.4 | 28.2 | 28.5 | 28.1 | 29.4 | 28.1 | 28.6 |
| | Deflection (mm) | 4.3 | 4.7 | 4.3 | 4.7 | 4.3 | 4.3 | 4.3 | 4.3 | 4.3 | 4.3 | 4.3 |
| Core hardness profile | Surface hardness (Cs) | 81 | 77 | 81 | 77 | 81 | 81 | 81 | 81 | 81 | 81 | 81 |
| | Hardness 7.5 mm toward core surface from midpoint M ($C_{M+7.5}$) | 79 | 75 | 79 | 75 | 79 | 79 | 79 | 79 | 79 | 79 | 79 |
| | Hardness 5 mm toward core surface from midpoint M ($C_{M+5}$) | 74 | 71 | 74 | 71 | 74 | 74 | 74 | 74 | 74 | 74 | 74 |
| | Hardness 2.5 mm toward core surface from midpoint M ($C_{M+2.5}$) | 68 | 65 | 68 | 65 | 68 | 68 | 68 | 68 | 68 | 68 | 68 |
| | Hardness at midpoint M between core center and surface ($C_M$) | 63 | 62 | 63 | 62 | 63 | 63 | 63 | 63 | 63 | 63 | 63 |
| | Hardness 2.5 mm toward core center from midpoint M ($C_{M-2.5}$) | 60 | 59 | 60 | 59 | 60 | 60 | 60 | 60 | 60 | 60 | 60 |
| | Hardness 5 mm toward core center from midpoint M ($C_{M-5}$) | 58 | 57 | 58 | 57 | 58 | 58 | 58 | 58 | 58 | 58 | 58 |
| | Hardness 7.5 mm toward core center from midpoint M ($C_{M-7.5}$) | 55 | 54 | 55 | 54 | 55 | 55 | 55 | 55 | 55 | 55 | 55 |
| | Center hardness (Cc) | 54 | 52 | 54 | 52 | 54 | 54 | 54 | 54 | 54 | 54 | 54 |
| | Surface hardness − Center hardness (Cs − Cc) | 27 | 25 | 27 | 25 | 27 | 27 | 27 | 27 | 27 | 27 | 27 |
| | Surface area A: ½ × 2.5 × ($C_{M-5}$ − $C_{M-7.5}$) | 3.3 | 3.8 | 3.3 | 3.8 | 3.3 | 3.3 | 3.3 | 3.3 | 3.3 | 3.3 | 3.3 |
| | Surface area B: ½ × 2.5 × ($C_{M-2.5}$ − $C_{M-5}$) | 2.9 | 2.5 | 2.9 | 2.5 | 2.9 | 2.9 | 2.9 | 2.9 | 2.9 | 2.9 | 2.9 |
| | Surface area C: ½ × 2.5 × ($C_M$ − $C_{M-2.5}$) | 3.8 | 3.8 | 3.8 | 3.8 | 3.8 | 3.8 | 3.8 | 3.8 | 3.8 | 3.8 | 3.8 |
| | Surface area D: ½ × 2.5 × ($C_{M+2.5}$ − $C_M$) | 6.3 | 3.8 | 6.3 | 3.8 | 6.3 | 6.3 | 6.3 | 6.3 | 6.3 | 6.3 | 6.3 |
| | Surface area E: ½ × 2.5 × ($C_{M+5}$ − $C_{M+2.5}$) | 7.5 | 7.5 | 7.5 | 7.5 | 7.5 | 7.5 | 7.5 | 7.5 | 7.5 | 7.5 | 7.5 |
| | Surface area F: ½ × 2.5 × ($C_{M+7.5}$ − $C_{M+5}$) | 6.3 | 5.0 | 6.3 | 5.0 | 6.3 | 6.3 | 6.3 | 6.3 | 6.3 | 6.3 | 6.3 |
| | Surface areas A + B + C | 10.0 | 10.0 | 10.0 | 10.0 | 10.0 | 10.0 | 10.0 | 10.0 | 10.0 | 10.0 | 10.0 |
| | Surface areas D + E | 13.8 | 11.3 | 13.8 | 11.3 | 13.8 | 13.8 | 13.8 | 13.8 | 13.8 | 13.8 | 13.8 |
| | Surface areas D + E + F | 20.0 | 16.3 | 20.0 | 16.3 | 20.0 | 20.0 | 20.0 | 20.0 | 20.0 | 20.0 | 20.0 |
| | (Surface areas D + E + F) − (Surface areas A + B + C) | 10.0 | 6.3 | 10.0 | 6.3 | 10.0 | 10.0 | 10.0 | 10.0 | 10.0 | 10.0 | 10.0 |
| | (Surface areas D + E) − (Surface areas A + B + C) | 3.8 | 1.3 | 3.8 | 1.3 | 3.8 | 3.8 | 3.8 | 3.8 | 3.8 | 3.8 | 3.8 |
| | [(Surface areas D + E + F) − (Surface areas A + B + C)]/(Cs − Cc) | 0.37 | 0.25 | 0.37 | 0.25 | 0.37 | 0.37 | 0.37 | 0.37 | 0.37 | 0.37 | 0.37 |
| | Surface hardness (Shore D) | 46 | 39 | 46 | 39 | 46 | 46 | 46 | 46 | 46 | 46 | 46 |
| | Center hardness (Shore D) | 26 | 25 | 26 | 25 | 26 | 26 | 26 | 26 | 26 | 26 | 26 |

TABLE 6

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Inner envelope layer | Material | No. 1 | No. 1 | No. 1 | No. 1 | No. 1 | No. 1 | No. 2 | No. 3 | No. 4 | — | — |
| | Thickness (mm) | 0.7 | 0.7 | 0.7 | 0.7 | 0.7 | 0.7 | 0.7 | 0.7 | 0.7 | — | — |
| | Sheet (Shore D) | 27 | 27 | 27 | 27 | 27 | 27 | 40 | 55 | 25 | — | — |
| Inner envelope layer-encased sphere | Diameter (mm) | 37.1 | 37.1 | 37.1 | 37.1 | 37.1 | 37.1 | 37.1 | 37.1 | 37.1 | — | — |
| | Weight (g) | 31.6 | 31.6 | 31.6 | 31.6 | 31.6 | 31.4 | 31.7 | 31.6 | 32.2 | — | — |
| | Surface hardness (Shore D) | 36 | 36 | 36 | 36 | 36 | 36 | 46 | 62 | 34 | — | — |
| Hardness difference: Inner envelope layer surface − Core surface | | −10 | −3 | −10 | −3 | −10 | −10 | 0 | 16 | −12 | — | — |
| Hardness difference: Inner envelope layer surface − Core center | | 10 | 11 | 10 | 11 | 10 | 10 | 20 | 36 | 8 | — | — |

TABLE 6-continued

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Outer envelope layer | Material | No. 2 | No. 2 | No. 2 | No. 2 | No. 2 | No. 3 | No. 1 | No. 2 | No. 5 | No. 6 | No. 1 |
| | Hardness (mm) | 0.7 | 0.7 | 0.7 | 0.7 | 0.7 | 0.7 | 0.7 | 0.7 | 0.7 | 1.4 | 1.4 |
| | Sheet (Shore D) | 40 | 40 | 40 | 40 | 40 | 55 | 27 | 40 | 41 | 47 | 40 |
| Outer envelope layer-encased sphere | Diameter (mm) | 38.5 | 38.5 | 38.5 | 38.5 | 38.5 | 38.5 | 38.5 | 38.5 | 38.5 | 38.5 | 38.5 |
| | Weight (g) | 35.1 | 35.1 | 35.1 | 35.1 | 35.1 | 35.1 | 35.1 | 35.1 | 35.1 | 35.1 | 35.1 |
| | Surface hardness (Shore D) | 46 | 46 | 46 | 46 | 46 | 62 | 33 | 46 | 47 | 53 | 46 |
| Hardness difference: Outer envelope layer surface − Inner envelope layer surface | | 10 | 10 | 10 | 10 | 10 | 26 | −13 | −16 | 13 | — | — |
| Hardness difference: Outer envelope layer surface − Core surface | | 0 | 7 | 0 | 7 | 0 | 16 | −13 | 0 | 1 | 7 | 0 |
| Intermediate layer | Material | No. 7 | No. 7 | No. 8 | No. 8 | No. 7 | No. 9 | No. 7 | No. 7 | No. 7 | No. 7 | No. 7 |
| | Thickness (mm) | 1.0 | 1.0 | 1.0 | 1.0 | 1.0 | 1.0 | 1.0 | 1.0 | 1.0 | 1.0 | 1.0 |
| | Sheet (Shore D) | 56 | 56 | 50 | 50 | 56 | 46 | 56 | 56 | 56 | 56 | 56 |
| Intermediate layer-encased sphere | Diameter (mm) | 40.5 | 40.5 | 40.5 | 40.5 | 40.5 | 40.5 | 40.5 | 40.5 | 40.5 | 40.5 | 40.5 |
| | Weight (g) | 39.8 | 39.8 | 39.8 | 39.8 | 39.8 | 39.8 | 39.8 | 39.8 | 39.8 | 39.8 | 39.8 |
| | Surface hardness (Shore D) | 62 | 62 | 56 | 56 | 62 | 52 | 62 | 62 | 62 | 62 | 62 |
| Hardness difference: Intermediate layer surface − Outer envelope layer surface | | 16 | 16 | 10 | 10 | 16 | −10 | 29 | 16 | 15 | 9 | 16 |
| Cover | Material | No. 10 | No. 10 | No. 10 | No. 10 | No. 11 | No. 10 | No. 10 | No. 10 | No. 10 | No. 10 | No. 10 |
| | Thickness (mm) | 1.1 | 1.1 | 1.1 | 1.1 | 1.1 | 1.1 | 1.1 | 1.1 | 1.1 | 1.1 | 1.1 |
| | Sheet (Shore D) | 62 | 62 | 62 | 62 | 62 | 62 | 62 | 62 | 62 | 62 | 62 |
| Coating layer | Material | I | I | I | I | I | I | I | I | I | I | I |
| | Sheet (Shore C) | 63 | 63 | 63 | 63 | 63 | 63 | 63 | 63 | 63 | 63 | 63 |
| Ball | Diameter (mm) | 42.7 | 42.7 | 42.7 | 42.7 | 42.7 | 42.7 | 42.7 | 42.7 | 42.7 | 42.7 | 42.7 |
| | Weight (g) | 45.5 | 45.5 | 45.5 | 45.5 | 45.5 | 45.5 | 45.5 | 45.5 | 45.5 | 45.5 | 45.5 |
| | Surface hardness (Shore D) | 68 | 68 | 68 | 68 | 59 | 68 | 68 | 68 | 68 | 68 | 68 |
| Hardness difference: Ball surface − Intermediate layer surface | | 6 | 6 | 12 | 12 | −3 | 16 | 6 | 6 | 6 | 6 | 6 |
| Dimples (Type) | | A | A | A | A | A | A | A | A | A | A | A |
| Hc − Cm (coating hardness − core center hardness) | | 9 | 11 | 9 | 11 | 9 | 9 | 9 | 9 | 9 | 9 | 9 |
| Total envelope layer thickness (inner layer thickness + outer layer thickness) (mm) | | 1.4 | 1.4 | 1.4 | 1.4 | 1.4 | 1.4 | 1.4 | 1.4 | 1.4 | 1.4 | 1.4 |
| Intermediate layer thickness + Cover thickness (mm) | | 2.1 | 2.1 | 2.1 | 2.1 | 2.1 | 1.9 | 2.1 | 2.1 | 2.1 | 2.1 | 2.1 |
| (Intermediate layer thickness + Cover thickness) − (Total envelope layer thickness) (mm) | | 0.7 | 0.7 | 0.7 | 0.7 | 0.7 | 0.5 | 0.7 | 0.7 | 0.7 | 0.7 | 0.7 |
| Cover thickness − Intermediate layer thickness (mm) | | 0.1 | 0.1 | 0.1 | 0.1 | 0.1 | 0.3 | 0.1 | 0.1 | 0.1 | 0.1 | 0.1 |

The flight performance (W #1) and feel at impact of each golf ball were evaluated by the following methods. The results are shown in Table 7.

Flight Performance

A driver (W #1) was mounted on a golf swing robot and the distance traveled by the ball when struck at a head speed of 35 m/s was measured and rated according to the criteria shown below. The club used was the PHYZ Driver (loft angle, 10.5°) manufactured by Bridgestone Sports Co., Ltd. In addition, using an apparatus for measuring the initial conditions, the spin rate was measured immediately after the ball was similarly struck.

Rating Criteria

Good: Total distance was 175.0 or more

NG: Total distance was less than 175.0 m

Feel

Sensory evaluations by amateur golfers having head speeds of 30 to 40 m/s were carried out on shots taken with a driver (W #1). The feel of the ball was rated according to the following criteria.

Rating Criteria

Good: Six or more out of ten golfers rated the ball as having a good feel

NG: Five or fewer out of ten golfers rated the ball as having a good feel

TABLE 7

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Flight (W#1; HS, 35 m/s) | Total distance (m) | 175.6 | 175.9 | 175.4 | 175.8 | 172.6 | 174.3 | 174.7 | 175.9 | 172.7 | 176.1 | 174.8 |
| | Rating | good | good | good | good | NG | NG | NG | good | NG | good | NG |
| Feel | Rating | good | good | good | good | good | good | good | NG | NG | NG | good |

As demonstrated by the results in Table 7, the golf balls of Comparative Examples 1 to 7 were inferior in the following respects to the golf balls according to the present invention that were obtained in the Examples.

The golf ball in Comparative Example 1 had a surface hardness that was lower than the surface hardness of the intermediate layer-encased sphere. As a result, when the ball was struck with a driver (W #1), the spin rate rose and the initial velocity of the ball decreased. Hence, a good distance was not achieved.

In the golf ball in Comparative Example 2, the surface hardness of the outer envelope layer-encased sphere was higher than the surface hardness of the intermediate layer-encased sphere. As a result, when the ball was struck with a driver (W #1), the spin rate rose and the initial velocity of the ball decreased, and so a good distance was not achieved.

In the golf ball in Comparative Example 3, the surface hardness of the inner envelope layer-encased sphere was higher than the surface hardness of the outer envelope layer-encased sphere. As a result, when the ball was struck with a driver (W #1), the spin rate rose and a good distance was not achieved.

In the golf ball in Comparative Example 4, the surface hardness of the inner envelope layer-encased sphere was higher than the surface hardness of the outer envelope layer-encased sphere. The surface hardnesses of the inner and outer envelope layers in this ball were each higher than in Comparative Example 3. As a result, the feel at impact on shots with a driver (W #1) was poor.

In Comparative Example 5, the resin materials for the inner and outer envelope layers were acid-containing resin materials, and were not composed primarily of the thermoplastic elastomers specified in this invention. As a result, the golf ball had a low initial velocity and a good distance was not achieved.

The golf ball in Comparative Example 6 was a four-piece ball in which the envelope layer consisted of a single layer. As a result, when struck with a driver (W #1), the ball had a hard feel at impact.

The golf ball in Comparative Example 7 was a four-piece ball in which the envelope layer consisted of a single layer. As a result, when struck with a driver (W #1), the ball had a high spin rate and a good distance was not achieved.

Japanese Patent Application No. 2019-088999 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an envelope layer, an intermediate layer and a cover, wherein the envelope layer is formed into two layers—an inner envelope layer and an outer envelope layer; the sphere obtained by encasing the core with the inner envelope layer (inner envelope layer-encased sphere), the sphere obtained by encasing the inner envelope layer-encased sphere with the outer envelope layer (outer envelope layer-encased sphere), the sphere obtained by encasing the outer envelope layer-encased sphere with the intermediate layer (intermediate layer-encased sphere) and the ball have respective surface hardnesses which together satisfy the following relationship:

surface hardness of inner envelope layer-encased sphere<surface hardness of outer envelope layer-encased sphere<surface hardness of intermediate layer-encased sphere<surface hardness of ball;

and the inner envelope layer or outer envelope layer is formed primarily of one or more thermoplastic elastomer selected from the group consisting of polyester elastomers, polyamide elastomers, polyurethane elastomers, olefin elastomers and styrene elastomers; and wherein the core has a hardness profile in which, letting Cc be the Shore C hardness at a center of the core, Cs be the Shore C hardness at a surface of the core, $C_M$ be the Shore C hardness at a midpoint M between the center and surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface and $C_{M-2.5}$, $C_{M-5.0}$ and $C_{M-7.5}$ be the respective Shore C hardnesses at positions 2.5 mm, 5.0 mm and 7.5 mm from the midpoint M toward the core center, the following surface areas A to F:

surface area A: $\frac{1}{2}\times 2.5\times(C_{M-5.0}-C_{M-7.5})$
surface area B: $\frac{1}{2}\times 2.5\times(C_{M-2.5}-C_{M-5.0})$
surface area C: $\frac{1}{2}\times 2.5\times(C_{M}-C_{M-2.5})$
surface area D: $\frac{1}{2}\times 2.5\times(C_{M+2.5}-C_{M})$
surface area E: $\frac{1}{2}\times 2.5\times(C_{M+5}-C_{M+2.5})$
surface area F: $\frac{1}{2}\times 2.5\times(C_{M+7.5}-C_{M+5})$ satisfy the condition (surface area *D*+surface area *E*+surface area *F*)−(surface area *A*+surface area *B*+surface area *C*)>0.

2. The golf ball of claim 1, wherein both the inner envelope layer and the outer envelope layer are formed primarily of one or more thermoplastic elastomer selected from the group consisting of polyester elastomers, polyamide elastomers, polyurethane elastomers, olefin elastomers and styrene elastomers.

3. The golf ball of claim 1, wherein surface areas A to F in the core hardness profile satisfy the condition (surface area *D*+surface area *E*)−(surface area *A*+surface area *B*+surface area *C*)≥0.

4. The golf ball of claim 1, wherein surface areas A to F in the core hardness profile satisfy the condition 0.15≤[(surface area *D*+surface area *E*+surface area *F*)−(surface area *A*+surface area *B*+surface area *C*)]/(*Cs*−*Cc*)≤0.60.

5. The golf ball of claim 1, wherein a coating layer is formed on a surface of the cover and, letting the Shore C hardness of the coating layer be Hc, the difference Hc−Cc between Hc and the Shore C hardness Cc at a center of the core is at least −5 and not more than 20.

6. The golf ball of claim 1, wherein the ball has from 250 to 370 dimples on the surface thereof, the dimples are of three or more dimple shapes, dimple diameter and dimple depth, the dimple coverage SR, defined as the proportion of the spherical surface of the golf ball accounted for by the dimples, is at least 75%, and the ball when struck has a coefficient of lift CL at a Reynolds number of 70,000 and a spin rate of 2,000 rpm which is at least 70% of the coefficient of lift CL at a Reynolds number of 80,000 and a spin rate of 2,000 rpm.

7. The golf ball of claim 1, wherein the ball has dimples on the surface thereof, the dimples are of non-spherical shape and the ball surface has a land thereon that is surrounded by a plurality of the non-spherical dimples, which land has a shape that includes at least one vertex, is contiguous at substantially a point with each of at least two neighboring lands and has a surface area in the range of 0.05 to 16.0 $mm^2$.

* * * * *